US010286530B2

(12) United States Patent
Fanguy et al.

(10) Patent No.: US 10,286,530 B2
(45) Date of Patent: May 14, 2019

(54) SAFETY WRENCH FOR CONDUIT UNION AND METHOD OF USE

(71) Applicants: Robert P. Fanguy, Broussard, LA (US); David J. Tilley, Franklin, LA (US)

(72) Inventors: Robert P. Fanguy, Broussard, LA (US); David J. Tilley, Franklin, LA (US)

( * ) Notice: Subject to any disclaimer, the term of this patent is extended or adjusted under 35 U.S.C. 154(b) by 162 days.

(21) Appl. No.: 15/609,340

(22) Filed: May 31, 2017

(65) Prior Publication Data

US 2018/0345463 A1 Dec. 6, 2018

(51) Int. Cl.
*B25B 21/02* (2006.01)
*B25B 21/00* (2006.01)

(52) U.S. Cl.
CPC ..... *B25B 21/02* (2013.01); *B25B 21/002* (2013.01); *B25B 21/005* (2013.01)

(58) Field of Classification Search
CPC ..... B25B 21/00; B25B 21/02; B25B 21/023; B25B 21/026; B25B 21/004; B25B 21/005; B25B 19/00; B25B 13/463; B25B 13/5008; B25B 13/48; E21B 19/163
USPC ..... 81/63.2, 33, 466, 463, 82; 173/202, 203, 173/128, 104; 227/132
See application file for complete search history.

(56) References Cited

U.S. PATENT DOCUMENTS 2,691,912 A 10/1954 Jones
4,080,851 A 3/1978 Rogers
5,138,915 A 8/1992 Doll
7,059,424 B2 * 6/2006 Neal ..... B25B 13/48 173/104
7,322,430 B2 1/2008 Littley
7,530,294 B2 5/2009 Myburgh
8,857,863 B1 10/2014 Patin et al.
9,186,780 B2 11/2015 Dumaine et al.
9,415,487 B2 8/2016 Wilson et al.
2008/0116688 A1 5/2008 Bull et al.
2011/0138969 A1 * 6/2011 Gouws ..... E21B 19/163 81/57.33
2012/0048069 A1 3/2012 Powell, Jr.
2014/0260821 A1 9/2014 Dumaine et al.
2015/0231768 A1 * 8/2015 Francis ..... B25B 21/005 29/426.5
2018/0250799 A1 * 9/2018 Hunt ..... B65G 7/12

FOREIGN PATENT DOCUMENTS

CN 2810346 6/2016

* cited by examiner

*Primary Examiner* — Monica S Carter
*Assistant Examiner* — Makena Markman
(74) *Attorney, Agent, or Firm* — William W. Stagg

(57) ABSTRACT

A safety wrench for coupling and uncoupling hammer union type connections employs a spring biased retractable bolt to apply a blow to the union lug. In use the bolt is retracted rearward to compress compression springs positioned within an internal spring bore in the bolt to a position away from the lug of the union to be rotated. When the bolt is disengaged from the ratchet mechanism, the compression springs rapidly extend to rapidly move the bolt forward to impact the union lug and rotate the union. The bolt may be retracted by a hydraulic or pneumatic cylinder, a hand lever, or a rack and pinion mechanism. Reversing the position of the safety wrench on the union lug will allow the union to be rotated in the opposite direction.

17 Claims, 12 Drawing Sheets

SAFETY WRENCH FOR CONDUIT UNION AND METHOD OF USE

FIELD OF THE INVENTION

This invention relates to tools for making up and breaking out conduit connections and more particularly to a safety wrench for coupling and uncoupling hammer union type pipe connections.

BACKGROUND OF THE INVENTION

Fluids, gases, and solids are often transported through conduits such as pipe and hoses which can be subjected to internal pressures. These conduits are typically comprised of multiple conduit segments that are connected together by threaded couplings. One such threaded coupling, a hammer union, utilizes an internally threaded nut having a plurality of lugs extending from its outer peripheral surface to threadedly secure conduit segments having corresponding adjoining male and female ends. A typical threaded union may have only 3 to 4 threads per inch so as to provide a robust connection with the least amount of nut rotation necessary in order to reduce the time required for tightening and loosening the union nut and correspondingly reduce the cost of assembling and disassembling conduit segments. However, the nut must still be tightened to a torque sufficient to avoid leakage of the fluids, gases, and solids being contained and to withstand the anticipated conduit internal fluid pressure to prevent the risks associated with unwanted disengagement of the connected adjoining conduits. Rotation of the lugged nut in one direction will tighten or makeup the union to couple the adjoining conduit segments together at a desired torque to prevent leaks. Rotation of the lugged nut in the opposite direction will loosen or breakout the union for uncoupling of the connected conduit segments. The lugged nut of a hammer union may be rotated by a variety of devices and methods.

One device used to rotate the lugged nuts is a manual handheld wrench or tong that has an elongated handle attached to a head that engages one or more of the outer lugs on the nut. The lugged nut is rotated by securing the wrench head to the lugs on the union nut and applying force to the elongated handle in the desired direction of rotation. Another device and method use to rotate union nut is a handheld sledge-type hammer. A worker uses the handheld hammer to strike the extending lugs on the union nut in a desired direction to rotate the nut to makeup and breakout the hammer union connection.

When conduit connections are made with a hammer or wrench it is often difficult to achieve or verify the torque required or desired for effectively mating the adjoining conduit segments. This is partially due to the differences is size, strength, and fatigue of the worker using the hammer. A larger worker may strike the union lug with more force than a smaller worker thus producing inconsistent torque values to the union being connected. Further, use of a handheld hammer is among the top causes of on-the-job injuries to workers. A worker swinging a hammer or striking or dropping a hammer can cause muscle strains, pinch points, broken limbs, smashed or broken fingers, or other injuries to the worker or others that may get in the way of the hammer. A hammer blow may also cause the hammer or union components to separate and produce shrapnel-like shards of flying metal that may cause eye injuries or other physical injuries to the worker or others in the vicinity. This danger is readily apparent because the makeup or breakdown of lugged nut on a hammer union requires a worker to apply repeated hammer blows to the lugs of the hammer union nut when workers or others are in close proximity. Workers working in such close proximity is common because it is often necessary to have one or more workers holding the conduit segments when another worker is striking the union lugs with the hammer in order to makeup or breakout the conduit connection.

Further, conduits are often assembled or disassembled in an area where flammable gases may be present. Striking a lug on a union nut with the head of a sledgehammer may lead to a glancing blow that creates sparks. These sparks can ignite such flammable gases. The use of such manual hammers increases the risk of explosions and fires that can cause severe burns or even death of surrounding workers and extensive property damage at the location.

Other problems are created when manual tongs or wrenches are used to makeup and breakdown the lugged nuts of hammer unions. Such manual tongs or wrenches require a worker to apply a torque with the handle of the tong or wrench sufficient to turn the lugged nut to a desired torque to makeup the connection of adjoining conduit segments and then to turn the lugged nut in the opposite direction with a torque sufficient to breakout the connection of the adjoining pipe segments. Often the moment force or torque applied to the threaded union by the tong jaws is not sufficient to adequately seal the conduit ends together which may result in leaks or cause the conduit to decouple under pressure. Further, a manual tong or wrench exposes the worker to the risk of back injuries when applying force on the handle of the tong or wrench the necessary to makeup or breakout the connection. Often the conduit segments are located in areas were a worker cannot be in a position to apply sufficient or consistent torque with a manual tong or wrench to properly makeup or breakout a union connection. Variables associated with the size and strength of a worker using a manual tong or wrench may result in the application of improper torque on the union connections and lead to inconsistent results when the connections are madeup. A union connection madeup with the application of improper torque may lead the connection to fail causing leakage of conduit contents and increase the risk of personal injuries and property damage associated with such leakage.

From the above it can be seen that there is a need for a replacement of conventional handheld hammers and manual wrenches and tongs used to makeup and breakdown the unions used to connect adjoining conduit segments in order to reduce the time to make conduit connections, reduce conduit sealing problems, and reduce the risk of harm for the workers and the risk of property damage at the work site location.

SUMMARY OF THE INVENTION

The present invention provides a safety wrench for coupling and uncoupling hammer union type connections that will eliminate the need for workers to use manual wrenches or tongs or manual hammers to makeup or breakout a threaded hammer union connection. The safety wrench is generally intended for use on unions having a plurality of lugs that extend radially from the outer peripheral surface of the union. Such unions are used to connect the adjacent threaded ends of conduit segments.

The safety wrench has a retractable bolt made from ferrous or non-ferrous metals with a hammer face that applies an impact force to the union lugs for rotation of the union. The bolt of the safety wrench is cocked or engaged to apply a blow to a union lug by a ratchet mechanism. When the bolt is cocked or engaged by the ratchet mechanism, the bolt is retracted against a compression spring positioned within a spring bore in the bolt to a position away from the lug of the union to be rotated. When the bolt is disengaged from the ratchet mechanism, the compression spring moves the bolt rapidly so that the bolt is extended toward the lug of the union to impact the bolt hammer face against the union lug with a predetermined impact force. The impact of the hammer face of the extended bolt on the union lug will rotate the union to threadedly connect or makeup the adjoining threaded conduit segments. The safety wrench may also be positioned on the union to allow the hammer face of the retractable bolt to impact the union lug in the opposite direction in order to rotate the union to disconnect or breakdown adjoining conduit segments.

The retractable bolt is slidably retained within the frame of the safety wrench in a bolt race slot to facilitate retraction and extension of the bolt within the hammer frame. In one embodiment the ratchet mechanism employed to engage and disengage the bolt includes a hydraulic or pneumatic cylinder and piston. In an alternate embodiment the ratchet mechanism employed to engage and disengage the bolt includes a hand operated lever. In still another embodiment the ratchet mechanism employed to engage and disengage the bolt includes a pinion gear mechanism.

Use of safety wrench will eliminate the need for worker to use manual hammers and manually manipulated wrenches and tongs and serve to insure that all unions are consistently madeup to a predetermined desired torque. Use of the safety wrench will thus reduce the aforementioned risks of injuries to workers or damage to property and will result in an overall reduction in the costs associated with the use of hammer union connections.

DETAILED DESCRIPTION OF THE EMBODIMENTS

Figure 1:
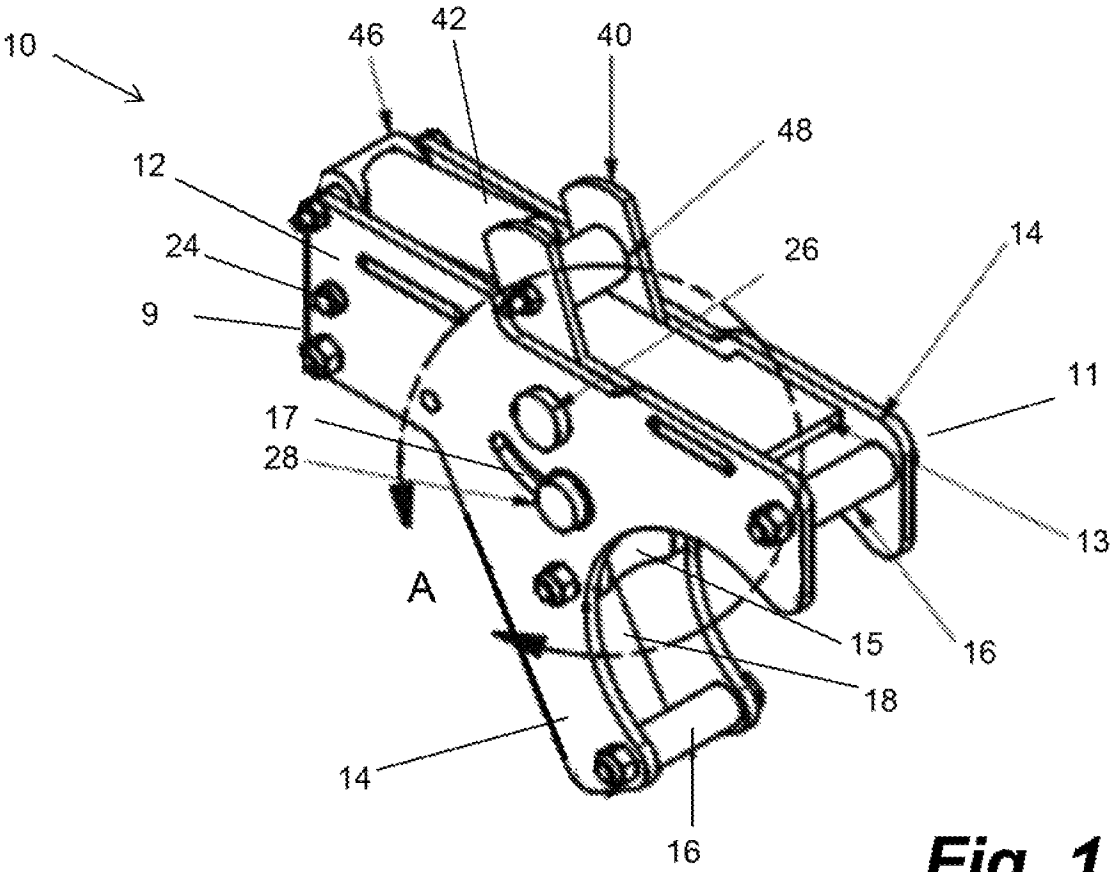
FIG. 1 is an isometric view of a first embodiment of the safety wrench of Applicant's invention.

In the drawings, features that are well established in the art and do not bear upon points of novelty are omitted in the interest of descriptive clarity. Such omitted features may include the details for operation of hydraulic or pneumatic cylinders such as pumps, fluid lines, and valves and connection components such bolts, nuts, screws, washers, bearings, screws, threaded junctures, weld lines, sealing elements.

FIGS. 1 through 5 show a first embodiment of the safety wrench 10. As shown in FIG. 1, an isometric view, and FIG. 5, an exploded view, safety wrench 10 has a rearward end 9 and a forward end 11 and is comprised of a frame 12 with a pair of corresponding spaced apart side plates 14 that are curved to create a lug pocket 18, and a top frame plate 13. Tubular spacers 15, 16, and 16A held in place by attachment bolts and nuts maintain the desired space between side plates 14 and serve to hold the safety wrench 10 in position on the lugs of a union. Positioned between the side plates 14 is a longitudinally extending retractable bolt 20.

Figure 8:
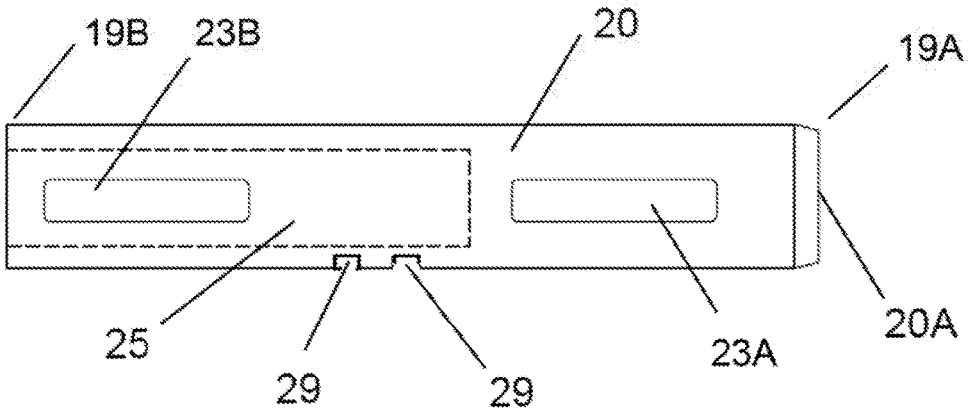
FIG. 8 is a schematic side-view of the retractable bolt of the safety wrench of Applicant's invention.

Bolt 20, shown in FIG. 8, has a forward end 19A, a rearward end 19B, forward bolt race slots 23A and rearward bolt race slots 23B. Bolt 20 also has an internal spring bore 25, a plurality of ratchet teeth 29 arrayed longitudinally along its lower surface, and a bolt face 20A at its forward end 19A.

Figure 2:
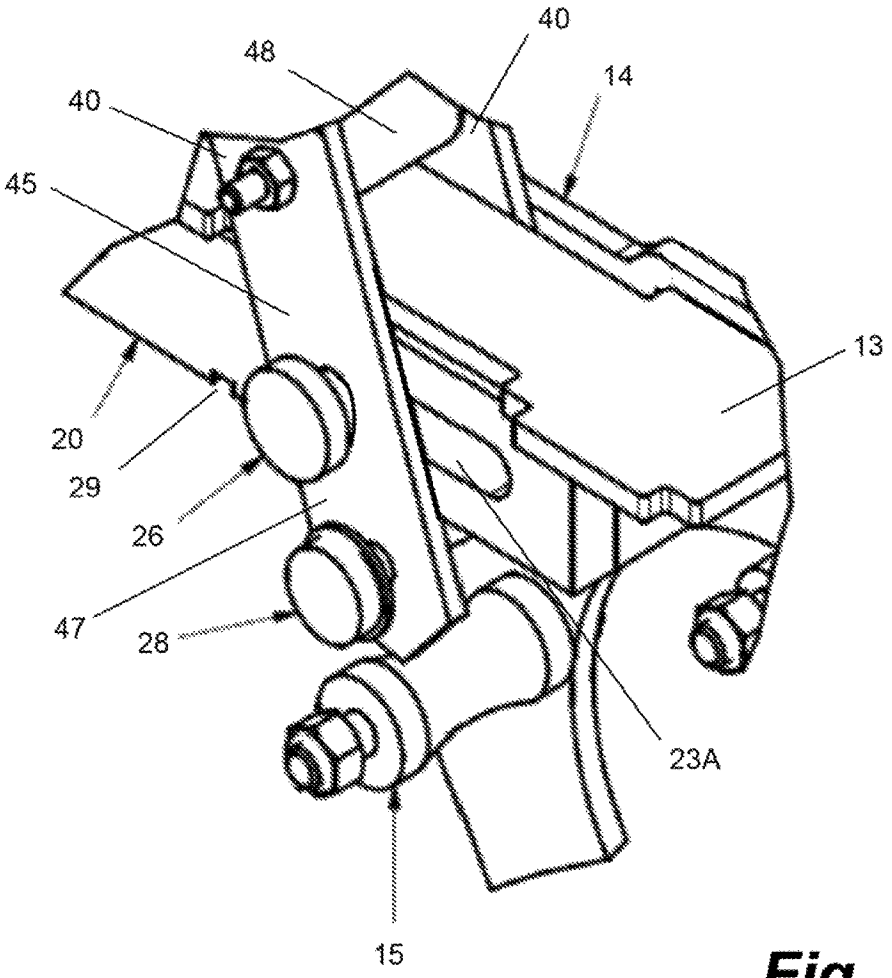
FIG. 2 is a partial cross-section detail view of the safety wrench shown in FIG. 1.
Figure 3:
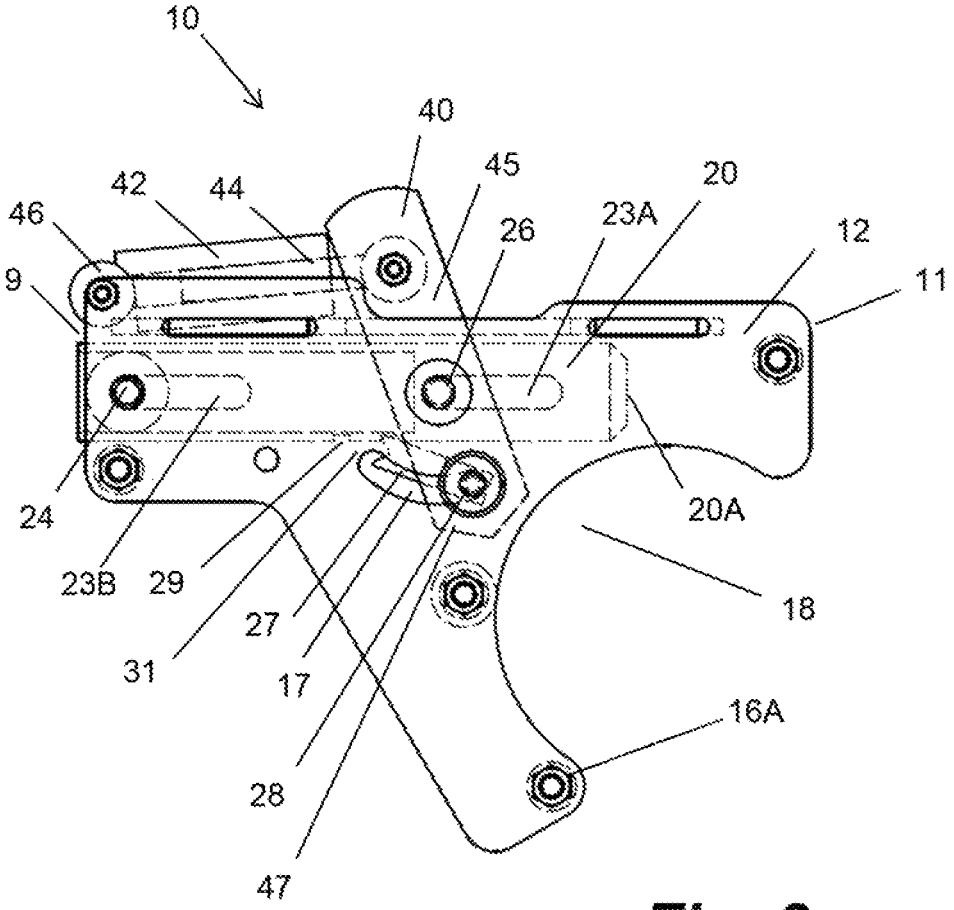
FIG. 3 is a side view of the safety wrench shown in FIG. 1.
Figure 4:
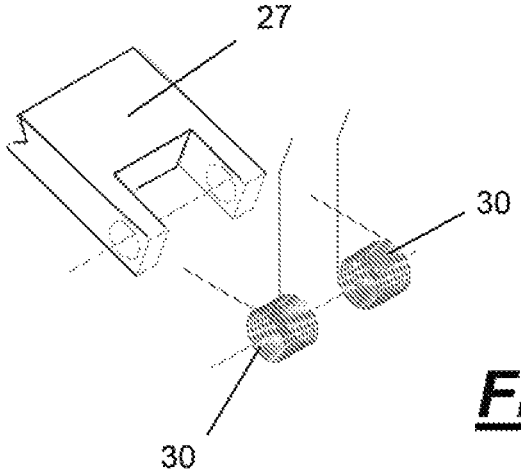
FIG. 4 is an isometric view of the pawl and torsion spring of the safety wrench shown in FIG. 1.
Figure 5:
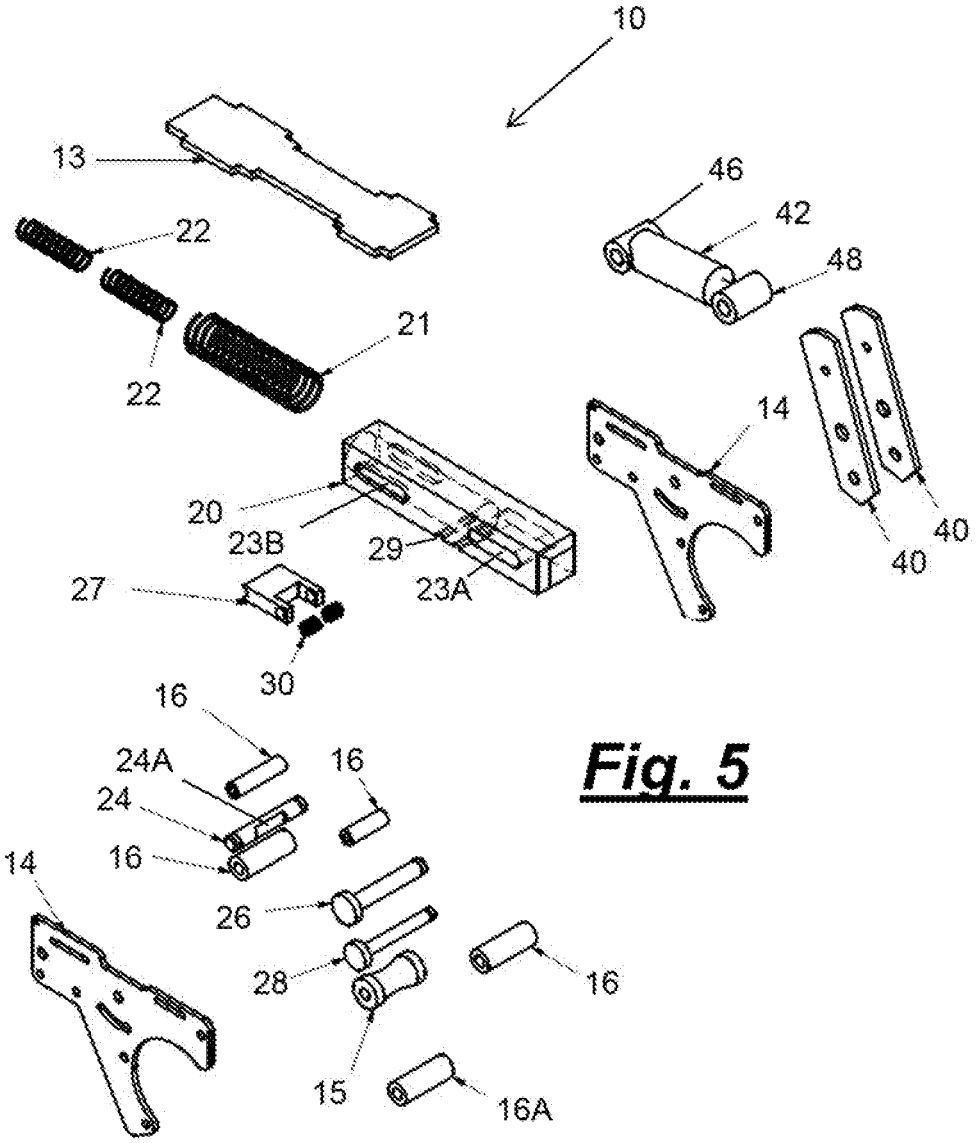
FIG. 5 is an exploded view showing the essential features of the safety wrench shown in FIG. 1.

As shown in FIG. 2, a cutaway view at the forward end 11 of safety wrench 10 shown as Detail A of FIG. 1, and in FIG. 3, bolt 20 is slidably retained within the frame 12 by rearward pin 24 that extend transversely between the side plates 14 of the frame 12 and through rearward bolt race slots 23B in the bolt 20. A compression spring 21 is positioned in the internal spring bore 25 of the bolt 20 where it is retained in place by retaining pin 24. A flat surface 24A as shown in FIG. 5 may be machined on the side of retaining pin 24 to aid in retaining compression spring 21 within the internal spring bore 25 of bolt 20.

Lever plates 40 are pivotally mounted between the side plates 14 of the frame 12 to pivot on bolt pin 26 that extends transversely between side plates 14 of frame 12 through the lever plates 40 and the forward bolt race slots 23A of bolt 20. Lever plates 40 have an upper section 45 above bolt pin 26 and a lower section 47 below bolt pin 26. A pawl pin 28 is mounted on the lower section 47 of the lever plates 40 so that pawl pin 28 will extend transversely between side plates 14 of frame 12 through in lever slots 17 in the side plates 14. When the upper section 45 of lever plates 40 are pivoted on bolt pin 26 toward the forward end 11 of safety wrench 10, the lower section 47 of the lever plates 40 are pivoted toward the rearward end 9 of safety wrench 10 to move pawl pin 28 rearward along the lever slots 17.

The bolt 20 is releasable restrained from forward movement and engaged for rearward movement with respect to frame 12 by bolt restraint 31. The bolt restraint 31 is comprised of pawl 27 pivotally mounted on pawl pin 28. Pawl 27 is biased toward the lower surface of the bolt 20 by torsion springs 30, shown separately in FIG. 4. The pawl 27 engages successive bolt ratchet teeth 29 at the lower surface of bolt 20. This engagement restrains forward movement of bolt 20 while allowing bolt 20 to be moved rearward within frame 12 in response to the forward pivotal movement of the upper section 45 of the lever plates 40.

A hydraulic cylinder and piston assembly comprised of a cylinder 42 and a piston rod 44 is provided to pivot the lever plates 40. The cylinder 42 is pivotally attached to the frame 12 by cylinder mount 46. The piston rod 44 is pivotally attached to the lever 40 by piston mount 48.

Figures 6A, 6B, 6C:
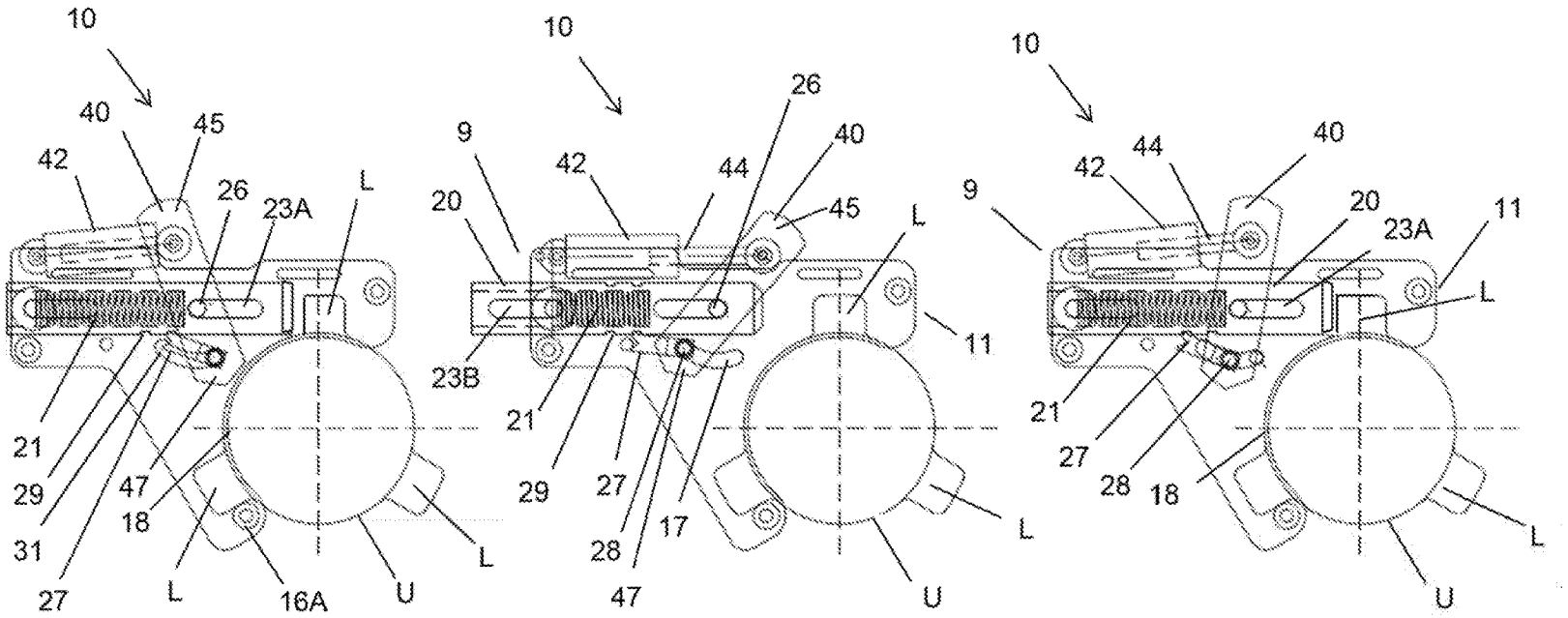
FIGS. 6A, 6B, and 6C show the sequence of operation of the safety wrench shown in FIG. 1.

FIGS. 6A, 6B, and 6C show the operation sequence of the safety wrench 10. As shown in FIG. 6A, a union U with a lug L is positioned with lug pocket 18 of safety wrench 10 so that spacer 16A is engaged with lug L. In this position the compression spring 21 is extended and bolt 20 is in a forward position. Extension of the piston rod 44 from the cylinder 42 will pivot the upper section 45 of lever plates 40 forward about bolt pin 26 and move the pawl pin 28 rearward in lever slots 17 as shown in FIG. 6B. This rearward movement of pawl pin 28 will engage pawl 27 with one of the ratchet teeth 29 on the bolt 20 and slide the bolt 20 toward the rearward end 9 of the frame 12 along bolt race slots 23A and 23B. The rearward movement of bolt 20 will compress spring 21 within the internal spring bore 25 of bolt 20 against retaining pin 24.

When the pawl 27 is engaged in the most rearward ratchet tooth 29, continued forward pivotal movement of the upper section 45 the lever plates 40 will disengage pawl 27 from the bolt restraint 31 causing compression spring 21 to rapidly extend, which in turn will rapidly move bolt 20 toward the forward end 11 of frame 12 as shown in FIG. 6C. This forward movement of bolt 20 will impact and cause the bolt face 20A to impact against lug L. This impact will serve to rotate the union U. The impact of the bolt face 20A on the lug L can be repeated by extending the piston rod 44 from the cylinder 42 to compress the spring 21 to start the sequence over.

Compression spring 21 is shown as a coiled compression spring but may be any type of compression spring including a gas compression spring. Compression spring 21 may be selected to provide a desired predetermined spring force on bolt 20. Additional compression springs 22 as shown in FIG. 5 may be inserted into the internal spring bore 25 of bolt 20 to increase the spring force and corresponding impact of the bolt 20 on the lug L. While compression springs 21 and 22 may be any type of compression spring, in most instances compression springs 21 and 22 will be die springs.

Figure 7:
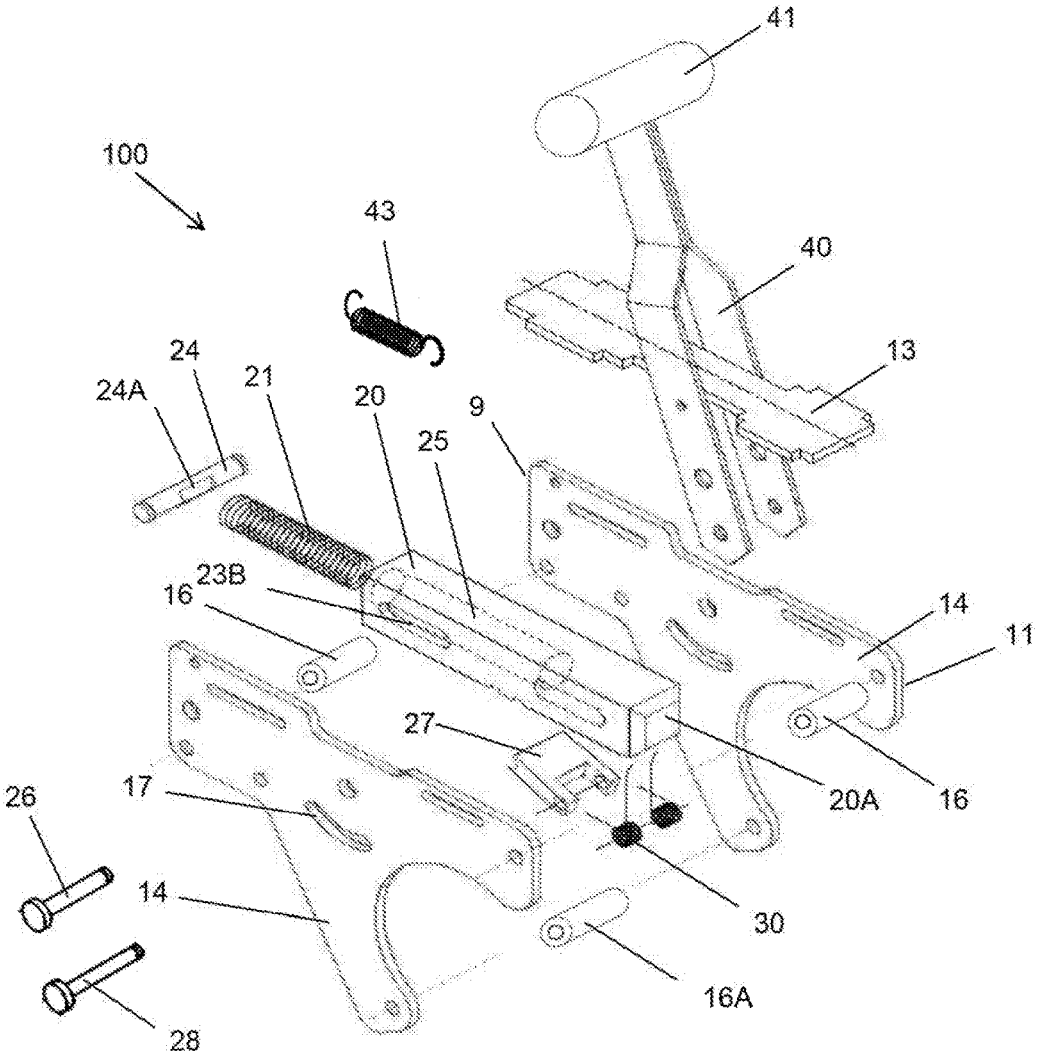
FIG. 7 is an exploded view showing the essential features of a second embodiment of the safety wrench of Applicant's invention.

FIG. 7 shows an exploded view of a second embodiment of the safety wrench 10 designated as safety wrench 100. In this embodiment the hydraulic cylinder assembly has been replaced by a lever handle 41 attached to lever plates 40 and a lever tension spring 43 attached to frame 12 and the lever plates 40. The remaining components of safety wrench 100 are the same as those of safety wrench 10.

Figures 9A, 9B, 9C:
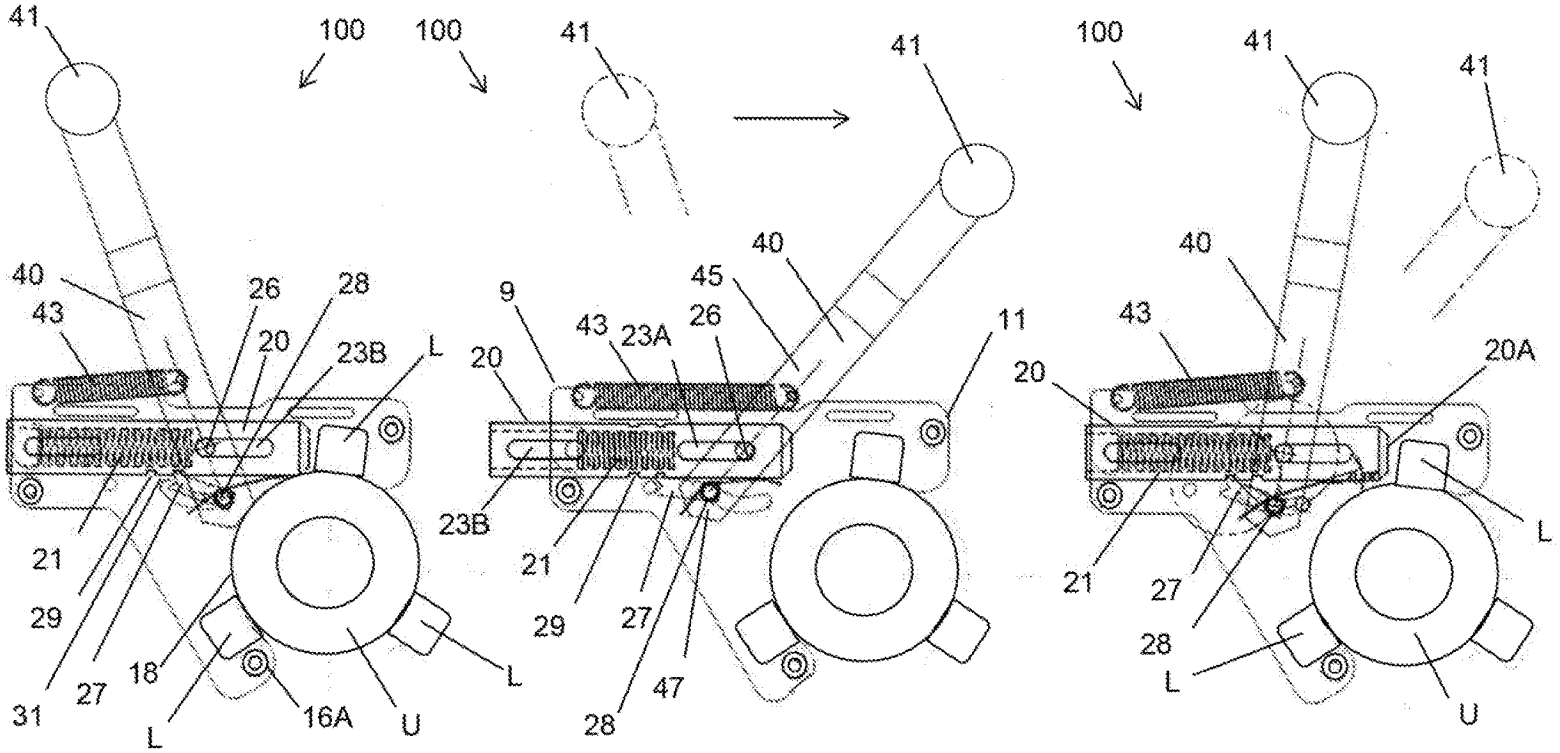
FIGS. 9A, 9B, and 9C show the sequence of operation of the second embodiment safety wrench shown in FIG. 7.

The sequence of operation of safety wrench embodiment 100 is shown in FIGS. 9A, 9B, and 9C and is substantially the same as that shown in FIGS. 6A, 6B, and 6C. FIG. 9A shows the safety wrench 100 with a union U positioned in lug pocket 18 with spacer 16A engaged with a lug L. In this position the compression spring 21 is extended and bolt 20 is in a forward position.

Moving the lever handle 41 toward the forward end 11 of safety wrench 100 will pivot the lever plates 40 about bolt pin 26 and move the lower section 47 of the lever plates 40 rearward. The rearward movement of lower section 47 of the lever plates 40 will move the pawl pin 28 rearward in lever slots 17 as shown in FIG. 9B. This rearward movement of pawl pin 28 will engage pawl 27 with one of the ratchet teeth 29 on the bolt 20 and slide the bolt 20 toward the rearward end 9 of the frame 12 along bolt race slots 23A and 23B. The rearward movement of bolt 20 will compress spring 21 within the internal spring bore 25 of bolt 20 against retaining pin 24.

When the pawl 27 is engaged in the most rearward ratchet tooth 29, continued forward pivotal movement of the upper section 45 the lever plates 40 will disengage pawl 27 from the bolt restraint 31 causing compression spring 21 to rapidly extend, which in turn will rapidly move bolt 20 toward the forward end 11 of frame 12 as shown in FIG. 9C. This forward movement of bolt 20 will impact and cause the bolt face 20A to impact against lug L. This impact will serve to rotate the union U. The impact of the bolt face 20A on the lug L can be repeated by extending the piston rod 44 from the cylinder 42 to compress spring 21 to start the sequence over.

Figure 10:
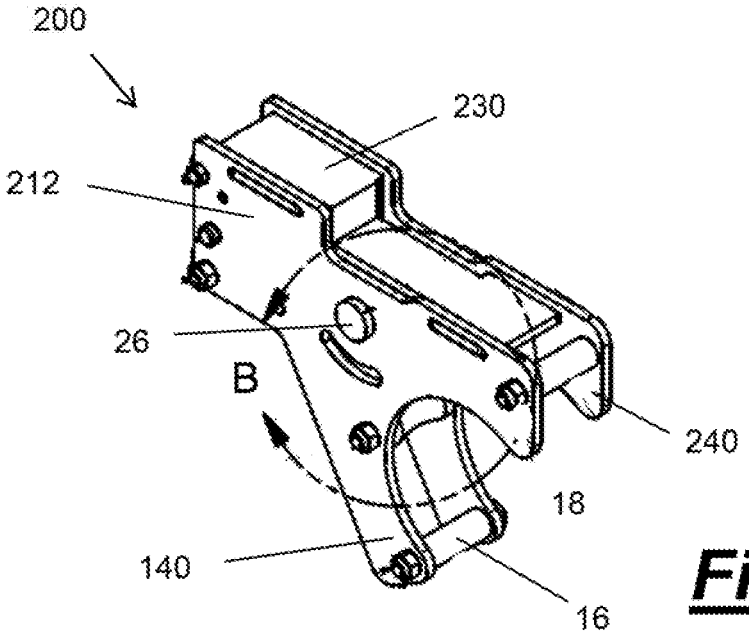
FIG. 10 is an isometric view of a third embodiment of the safety wrench of Applicant's invention.

FIG. 10 through 13 show a third embodiment of the safety wrench 10 designated as safety wrench 200. As shown in FIG. 10, an isometric view, and FIG. 13, an exploded view, the side plates 214 and the top plate 213 of frame 212 are modified to retain the components of rack and pinion mechanism 50 best shown in the side view of FIG. 12 that replaces the hydraulic cylinder assembly and lever mechanisms of the previously described embodiments. In safety wrench 200, frame 212 is otherwise configured with a lug pocket 18 and tubular spacers 15, 16, and 16A held in place by attachment bolts and nuts to maintain the desired space between side plates 214. Slidably positioned within frame 212 of safety wrench 200 is a longitudinally extending bolt 220 having a forward end 19A and a rearward end 191, an internal spring bore 25, longitudinally extending rearward bolt race slots 23B, longitudinally extending forward bolt race slot 23A, and a bolt face 20A at forward end 19A.

Figure 11:
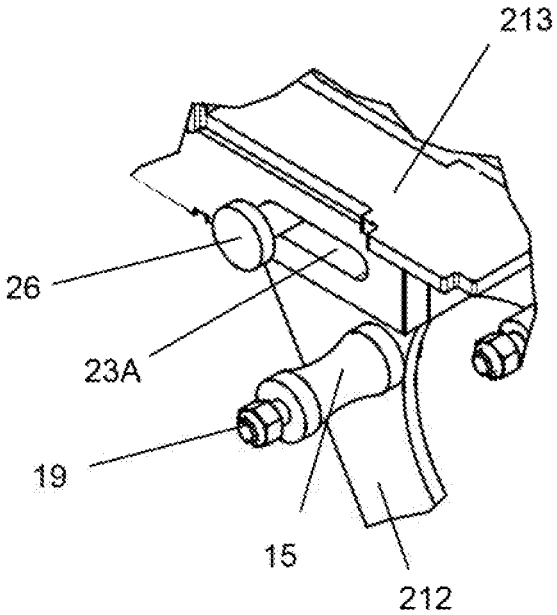
FIG. 11 is a partial cross-section detail view the third embodiment of the safety wrench shown in FIG. 10.

As best illustrated in FIG. 11, a cutaway view at the forward end 11 of safety wrench 200, shown as Detail B of FIG. 10, the bolt 220 is slidably retained within the frame 212 by bolt pin 26 that extends transversely between side plates 214 of frame 212 through the forward bolt race slot 23A of bolt 20. Toward the rearward end 9 of frame 212, a retaining pin 24 extends transversely between the side plates 214 and through corresponding rearward bolt race slots 23B in the bolt 220 to slidably restrain the bolt 220 and to retain a compression spring 21 in the internal spring bore 25 of bolt 220. A flat surface 24A may be machined on the side of retaining pin 24 to aid in placement of compression spring 21 within the bolt 220.

Figure 12:
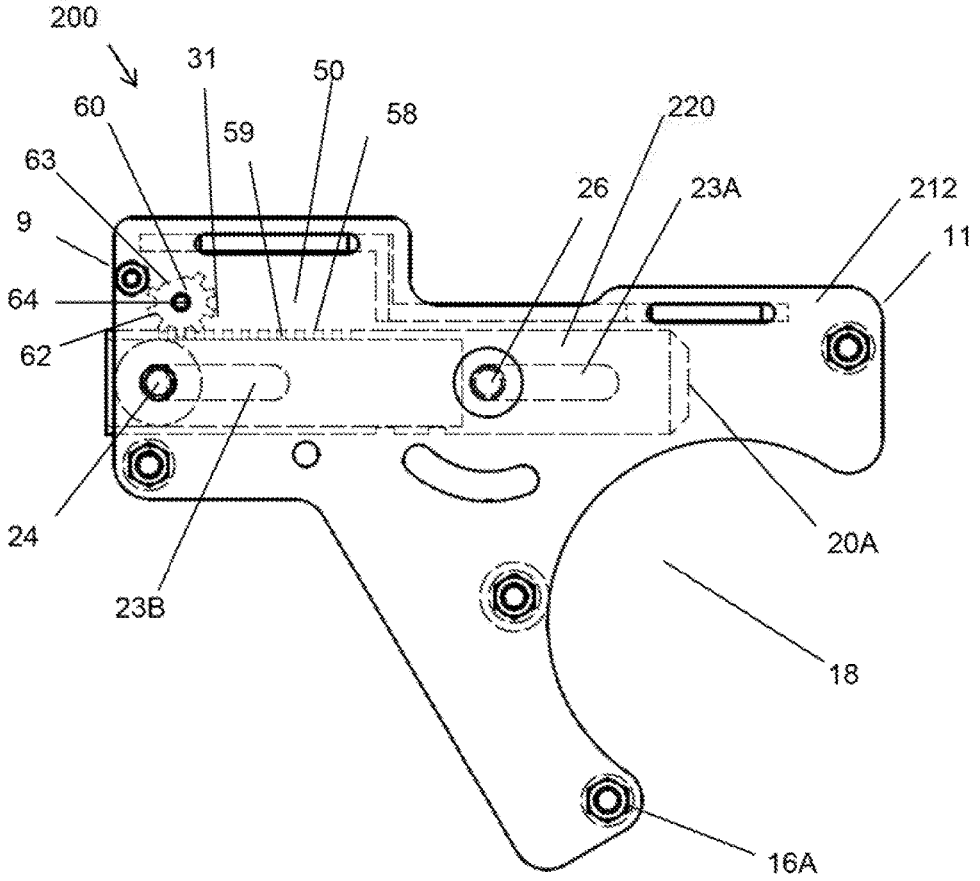
FIG. 12 is a side view of the third embodiment of the safety wrench shown in FIG. 10.

The rack and pinion mechanism 50 of safety wrench 200 shown in FIG. 12 is comprised of a linear gear rack 58 on the top surface of the retractable bolt 220 that engages with a pinion gear 60 mounted to frame 212. The linear gear rack 58 has a plurality rack gear teeth 59 that engage with a plurality of equally spaced pinion gear teeth 62 arrayed around pinion gear 60. A tooth gap 63 on pinion gear 60 separates the array of pinion gear teeth 62. The rack and pinion mechanism 50 serves as alternate embodiment of bolt restraint 31 and as a mechanism to retract bolt 20 toward the rearward end 9 of Frame 212.

Figure 13:
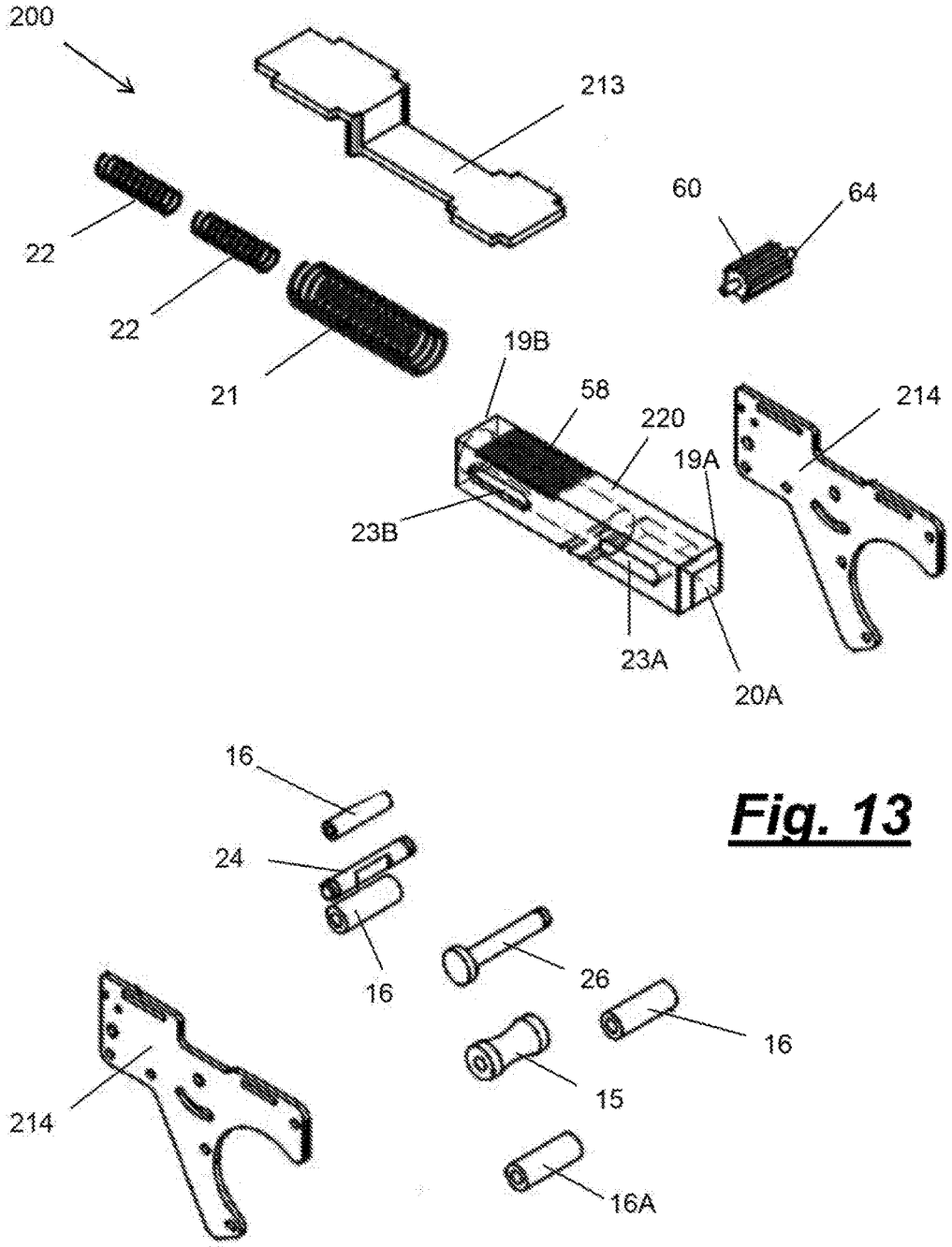
FIG. 13 is an exploded view showing the essential features of the third embodiment of the safety wrench shown in FIG. 10.

The pinion gear 60 has an extending gear shaft 64 shown in FIG. 13. The gear shaft 64 allows the pinion gear 60 to be connected for rotation by a variety of rotation devices such as hand operated power drills, drill drivers, or hammer drills. The pinion gear teeth 62 mesh with the spaced gear teeth 59 of the rack 58 on the bolt 220.

Figure 14B:
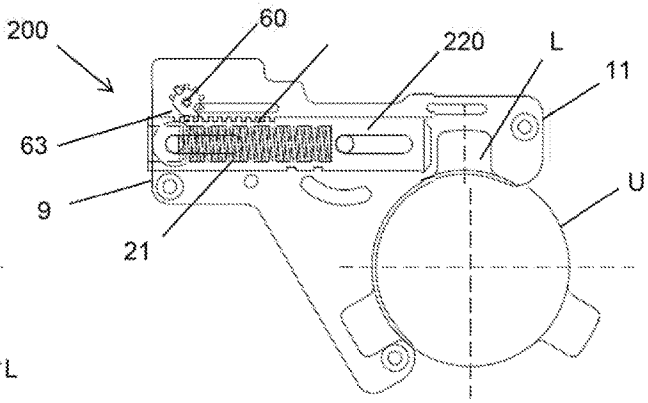
FIGS. 14A, 14B, 14C, and 14D show the sequence of operation of the third embodiment safety wrench shown in FIG. 10.
Figure 14A:
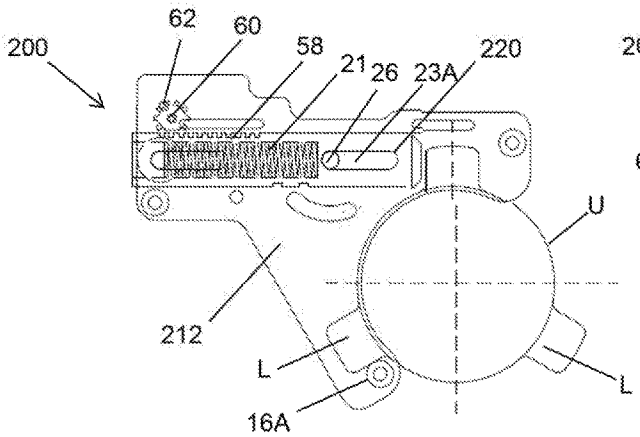
Figure 14D:
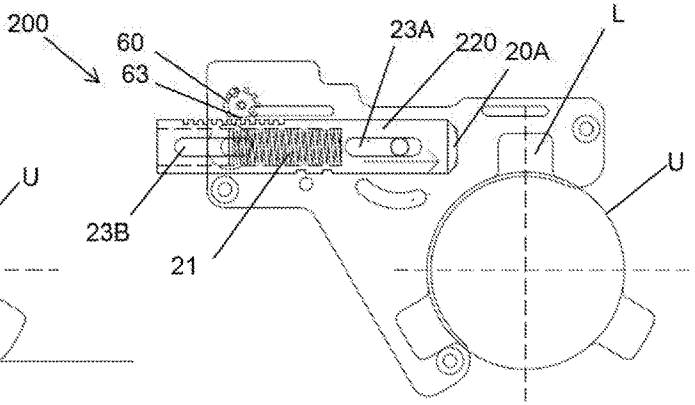
Figure 14C:
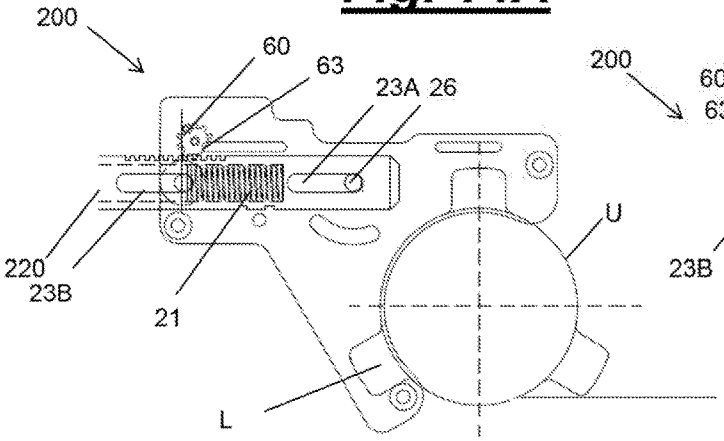

FIGS. 14A, 14B, 14C, and 6D show the operation sequence of the safety wrench 200. FIG. 14A shows the safety wrench 200 positioned with lug pocket 18 receiving a union U with spacer 16A engaged with lug L. In this position the compression spring 21 in the internal spring bore 25 is extended and bolt 220 is in a forward position. Rotation of the pinion gear 60 will engage the pinion gear teeth 62 with the gear teeth 59 of the bolt gear rack 58 to begin to move the bolt 220 rearward along bolt race slots 23A and 23B as shown in FIG. 14B. Continued rotation of the pinion gear 60 will continue rearward movement of the bolt 220 and will compress spring 21 within internal spring bore 25 against retaining pin 24 as the bolt 220 retracts reward along bolt race slots 23A and 23B as shown in FIG. 14C. Further rotation of pinion gear 60 will position the tooth gap 63 in line with the gear rack 58 and disengage the pinion gear 60 from the gear rack 58 and release the bolt 220. Releasing bolt 220 will allow the compressed spring 21 to rapidly extend, which in turn will move bolt 220 forward rapidly to impact the bolt face 20A against a lug L as shown in FIG. 14D. This impact will rotate the union U. The impact of bolt face 20A on lug L can be repeated by continued rotation of the pinion gear 60 to engage pinion gear teeth 62 with the rack gear teeth 59 on bolt 220 to compress spring 21 to start the sequence over.

Because many varying and different embodiments may be made within the scope of the inventive concept disclosed in this specification, and because many modifications may be made in the described embodiments, it is to be understood that the details herein are to be interpreted as illustrative and not in any limiting sense.

We claim:

1. An apparatus for rotating a union having a plurality of radially extending lugs comprising:

a) a frame having a forward end and a rearward end;

b) a longitudinally extending bolt slidably mounted within said frame, said bolt having a forward end and a rearward end, a lower surface, an internal spring bore at said rearward end of said bolt, a forward bolt race slot, a rearward bolt race slot, and a plurality of bolt ratchet teeth arrayed longitudinally along said lower surface of said bolt;

c) a compression spring positioned in said spring bore of said bolt;

d) a retaining pin positioned transversely in said rearward bolt race slot of said bolt retaining said compression spring within said spring bore;

e) a lever having an upper section and a lower section;

f) a bolt pin pivotally mounting said lever between said upper and said lower sections of said lever, said bolt pin positioned transversely in said forward bolt race slot of said bolt;

g) a pawl pivotally attached to said lower section of said lever, said pawl biased toward said lower surface of said bolt;

h) whereby movement of said lever toward said forward end of said frame will pivot said lower section of said lever rearward to engage said pawl with said bolt ratchet teeth on said bolt to releasably restrain said bolt from forward motion and move said bolt rearward within said frame along said forward and rearward bolt race slots thereby compressing said compression spring against said retaining pin; and i) wherein disengagement of said bolt from said pawl will extend said bolt to impact a radially extending lug on a union.

2. The apparatus as recited in claim 1, wherein rearward movement of said bolt will disengage said bolt from said pawl.

3. The apparatus as recited in claim 2 wherein said frame is repositionable on said union to impact said lug on said union from the opposite direction.

4. The apparatus as recited in claim 3, wherein said frame has a pocket for receiving said union.

5. The apparatus recited in claim 3 wherein said compression spring is comprised of at least two coiled compression springs positioned in said internal spring bore of said bolt.

6. The apparatus as recited in claim 5 wherein at least one of said coiled compression springs is a die spring.

7. The apparatus as recited in claim 3, wherein said lever is pivoted manually.

8. The apparatus as recited in claim 3, wherein said lever is pivoted by extension of a piston rod from a hydraulic cylinder.

9. An apparatus for rotating a union comprising:

a) a union having a radially extending lug;

b) a frame having a forward end, a rearward end, and a pair of spaced apart side plates;

c) a longitudinally extending bolt slidably mounted within said frame, said bolt having a forward end and a rearward end, and an internal spring bore at said rearward end of said bolt;

d) a compression spring positioned within said internal spring bore of said bolt, wherein said compression spring will compress upon movement of said bolt toward said rearward end of said frame;

e) a releasable bolt restraint engaged with said bolt, said bolt restraint restraining said bolt from forward movement when said bolt is moved toward said rearward end of said frame; and f) wherein disengagement of said bolt from said bolt restraint will extend said compression spring to move said bolt toward said forward end of said frame to impact said lug on said union with said forward end of said bolt.

10. The apparatus as recited in claim 9 wherein said frame is repositionable on said union to impact said lug on said union from the opposite direction.

11. The apparatus recited in claim 10 wherein said compression spring is comprised of at least two coiled compression springs positioned within said internal spring bore of said bolt.

12. The apparatus as recited in claim 11 wherein at least one of said coiled compression springs is a die spring.

13. The apparatus as recited in claim 10 wherein said releasable bolt restraint includes a pawl pivotally mounted on said frame wherein said pawl is engaged with ratchet teeth on said bolt.

14. The apparatus recited in claim 13 wherein said bolt is moved toward said rearward end of said frame by a lever pivotally mounted to said frame.

15. The apparatus as recited in claim 14 wherein said lever is moved by a hydraulic cylinder and piston assembly mounted on said frame.

16. The apparatus recited in claim 10 wherein said bolt has a plurality of rack gear teeth and wherein said bolt is moved toward said rearward end of said frame by rotation of a pinion gear having a plurality of pinion gear teeth engaged with said rack gear teeth on said bolt.

17. The apparatus recited in claim 16 wherein said releasable bolt restraint includes a pinion gear having a gap in said a plurality of pinion gear teeth.

* * * * *